US005787854A

United States Patent [19]

Uhlig et al.

[11] Patent Number: 5,787,854

[45] Date of Patent: Aug. 4, 1998

[54] DEVICE WITH FUEL INJECTION AND LUBRICANT DELIVERY MEANS FOR INTERNAL COMBUSTION ENGINES

[75] Inventors: Ronald Uhlig, Zoeblitz; Andreas Singer, Fraureuth; Klaus Matthees, Freiberg; Peter Schulz, Chemnitz, all of Germany

[73] Assignee: Dolmar GmbH, Hamburg, Germany

[21] Appl. No.: 817,240

[22] PCT Filed: Aug. 2, 1996

[86] PCT No.: PCT/EP96/03424

§ 371 Date: Apr. 10, 1997

§ 102(e) Date: Apr. 10, 1997

[87] PCT Pub. No.: WO97/06359

PCT Pub. Date: Feb. 20, 1997

[30] Foreign Application Priority Data

Aug. 10, 1995 [DE] Germany ..... 195 29 368.1

[51] Int. Cl.[6] ..... F01M 1/02

[52] U.S. Cl. ..... 123/196 R; 123/198 C; 184/11.5; 184/27.2; 417/437

[58] Field of Search ..... 123/196 R, 496, 123/198 C; 184/11.5, 27.2, 27.4, 31, 32; 417/437, 274

[56] References Cited

U.S. PATENT DOCUMENTS

| | | | |
|---|---|---|---|
| 3,938,622 | 2/1976 | Densow | 184/32 |
| 4,016,656 | 4/1977 | Karlsson | 184/32 |
| 4,383,504 | 5/1983 | Walsworth | 123/73 AD |
| 4,411,602 | 10/1983 | Ray | 417/437 |
| 4,539,949 | 9/1985 | Walworth | 123/196 R |
| 4,551,076 | 11/1985 | DuBois | 123/73 AD |
| 4,679,659 | 7/1987 | Jendick | 184/27.2 |
| 4,715,791 | 12/1987 | Berlin et al. | 417/274 |
| 4,944,658 | 7/1990 | Buttner | 417/274 |
| 5,315,971 | 5/1994 | Yamada | 123/76 AD |

FOREIGN PATENT DOCUMENTS

| | | |
|---|---|---|
| 3637360A1 | 5/1987 | Germany . |
| 9203378 U | 6/1992 | Germany . |

OTHER PUBLICATIONS

Patent Abstracts of Japan, vol. 012, No. 131 (M-688), Apr. 22, 1988 & JP.A.62 253927 (Sanshin Ind. Co. Ltd.), Nov. 5, 1987, Abstract .

Patent Abstracts of Japan, vol. 009, No. 155 (M-392), Jun. 29, 1985 & JP.A.60 030427 (Iseki Noki KK), Feb. 16, 1985, Abstract.

Patent Abstracts of Japan, vol. 008, No. 140 (M-305), Jun. 29, 1984 & JP.A.49 037260 (Yanmar Diesel KK), Feb. 29, 1984, Abstract.

*Primary Examiner*—Erick R. Solis

*Attorney, Agent, or Firm*—Townsend And Townsend And Crew LLP; William Michael Hynes

[57] ABSTRACT

In order to provide a device with fuel injection and lubricant feed means for internal combustion engines, preferably for manual guided equipment, such as chain saws, with a helical gear wheel (12) mounted on a crankshaft (11) or driven indirectly by the crankshaft (11), which is in engagement with a mating gear wheel (13) for driving the lubricant pump (16), wherein a piston (17) of the lubricant pump (16) forms a trunnion for the mating gear wheel (13) and possesses an oblique anterior surface (18) which bears against a lifting stud (20) adjustably retained in the housing, for aiding lubricant delivery adjustment of the lubricant pump (16), in a compact assembly, preferably a chain saw with several, lubrication circuits and a high-pressure fuel feed it is proposed that the helical gear wheel (12) be in engagement with two mating gear wheels (13,14), each connected with a drive shaft (17,26) for one lubricant pump (16,31) and/or one fuel pump (27).

8 Claims, 3 Drawing Sheets

DEVICE WITH FUEL INJECTION AND LUBRICANT DELIVERY MEANS FOR INTERNAL COMBUSTION ENGINES

The invention relates to a device with fuel injection and lubricant feed means for internal combustion engines, preferably for manually guided equipment, such as chain saws. The invention comprises a helical gear wheel mounted on a crankshaft or driven indirectly by the crankshaft, which is in engagement with a mating gear wheel for driving the lubricant pump, wherein a piston of the lubricant pump forms a trunnion for the mating gear wheel and possesses an oblique anterior surface area which bears against a lifting stud adjustably retained in the housing, the lifting stud aids adjustments of the lubricant pump delivery volume.

BACKGROUND OF THE INVENTION

Hand-held chain saws, have predominantly used valveless piston pump mechanism to lubricate the cutting chain. A typical oil pump of the prior art possesses a cylindrical pump chamber constructed in the pump housing. The pump chamber possesses an inlet aperture, an outlet aperture and a pump piston that rotates in the pump chamber by means of a gear formed by a helical gear wheel and a mating gear wheel. The gear has stemmed support on one side and has, on the other side, an oblique anterior surface area that bears against a lifting stud disposed off center to the pistion longitudinal axis of the piston . When the piston rod is rotated, an axial movement is produced which is utilized for pumping. An axially adjustable stop allows different strokes of the pump piston to be set. This lubricant feed means is usually flange-mounted on the internal combustion engine, together with the fuel injection means as a secondary unit.

German patent No. DE 37 35 711 A1, teaches a portable, manually controlled apparatus powered by a two-stroke engine, such as a powered saw or the Like, with a pneumatically operated injection pump for the injection of fuel and a suction pipe to control the air mix for combustion, and having a handle-bearing housing designed for minimal vibration and ease of carrying and guiding. This apparatus has an injection pump that disposed separately from the two-stroke engine in the handle-bearing housing and that is connected with the two-stroke engine by means of non-rigid connections.

In German patent No. DD-PS 41 648, lubrication pumps for internal combustion engines are disclosed that possess two consecutively mounted, revolving piston-controlled feed units. These pumps initiate the constant travel of a cam plate gear which is greatly reduced relative to the rotational speed of the engine. The first feed unit supplies the lubricant and the second feed unit supplies the fuel. Both media are delivered as a mixture to the internal combustion engine, a two-stroke engine.

SUMMARY OF THE INVENTION

The present invention provides a compact assembly for equipment having a compact internal combustion engine assembly, fuel injection circuits and a high-pressure fuel feed mechanism, preferably in a chain saw possessing several, controllable lubrication circuits and a high-pressure fuel feed mechanism.

What is needed is a device that combines fuel injection and lubricant feed means in a space-efficient manner that is compatible with the compact engine design of hand-held, manually guided equipment.

The present invention provides a compact assembly for hand-held, manually guided equipment having a compact internal combustion engine assembly, fuel injection circuits and a high-pressure fuel feed mechanism and is particularly sited to a chain saw having these features.

Whereas the prior art provides fuel injection and lubricating means as separate devices for the type of equipment described above, the present invention effectively combines the fuel injection and lubrication means in the smallest possible space, by having a helical gear wheel in engagement with two mating gear wheels, each of which is connected to a drive shaft for a lubricant pump and/or a fuel pump and by using the crankshaft as the driving means. In one embodiment of the invention, the joint gears comprised by the crankshaft via the helical gear wheel and the mating gear wheels for the lubricant pump and/or fuel pump can be aligned in parallel or in a V-like manner in relation to each other. Persons skilled in the art will understand that it is substantially possible hereby to select the configuration most favorable as a secondary unit for the device in question.

According to a first embodiment of the invention, one lubricant feed unit is assigned to each side of a first mating gear wheel and the two feed units are preferably driven by a cam plate on one of the feed units. The aforementioned oblique anterior surface of the piston rod serves as a cam plate in this embodiment. In order to convey different pump outputs via the feed units, the lubricant feed units possess differently dimensioned piston surface areas. preferably, the second mating gear wheel drives the fuel pump, which is constructed in the form of a plunger pump.

As an alternative to this it is possible for one feed unit to be assigned to each side of one of the mating gear wheels, one of said feed units being a continuously operating fuel pump and the other feed unit being a lubricant pump whose delivery is adjustable. The feed unit stroke is adjusted with the lifting stud which serves as a stop and connected with a set-screw that, can be turned in a thread integral with the housing. The axial position of the lifting stud is adjusted using the set-screw. It is also possible to change the radial position of the lifting stud relative to the longitudinal axis of the piston of the pump. In the aforedescribed embodiment, a rigidly adjustable Lubricant pump is preferably allotted to the second mating wheel (on the opposite side of the from the first mating wheel crankshaft). For the controllable Lubricant pump, disposed on the same side as the fuel pump, the adjustment unit is an axis above the axes of the mating gear wheels and preferably located transversally to the axis of the crankshaft.

In a further embodiment of the invention, the mating gear wheel driving the fuel pump is axially run on both sides in the housing block, as is the mating gear wheel which drives the lubricant feed means. Preferably, the piston or the cam plate and/or the fuel pump is non-rotatingly, but unidirectionally movable with the assigned mating gear wheel. It should be further noted that, all lubricant pumps can be constructed in the form of controllable feed units.

DETAILED DESCRIPTION OF THE PREFERRED EMBODIMENT

Figure 1:
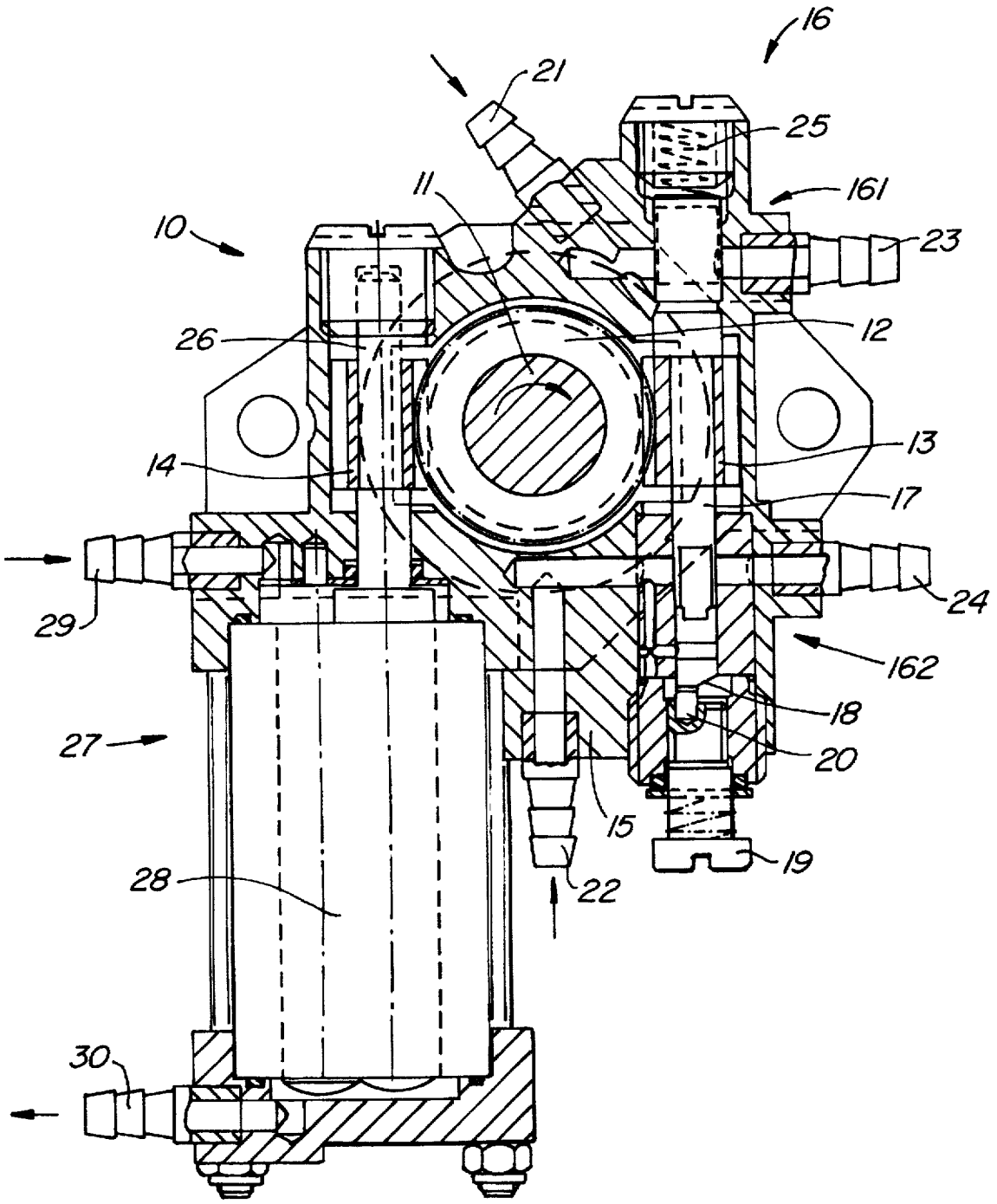
FIG. 1 shows a first embodiment of the invention in section transversely to the crankshaft axis.
Figure 2:
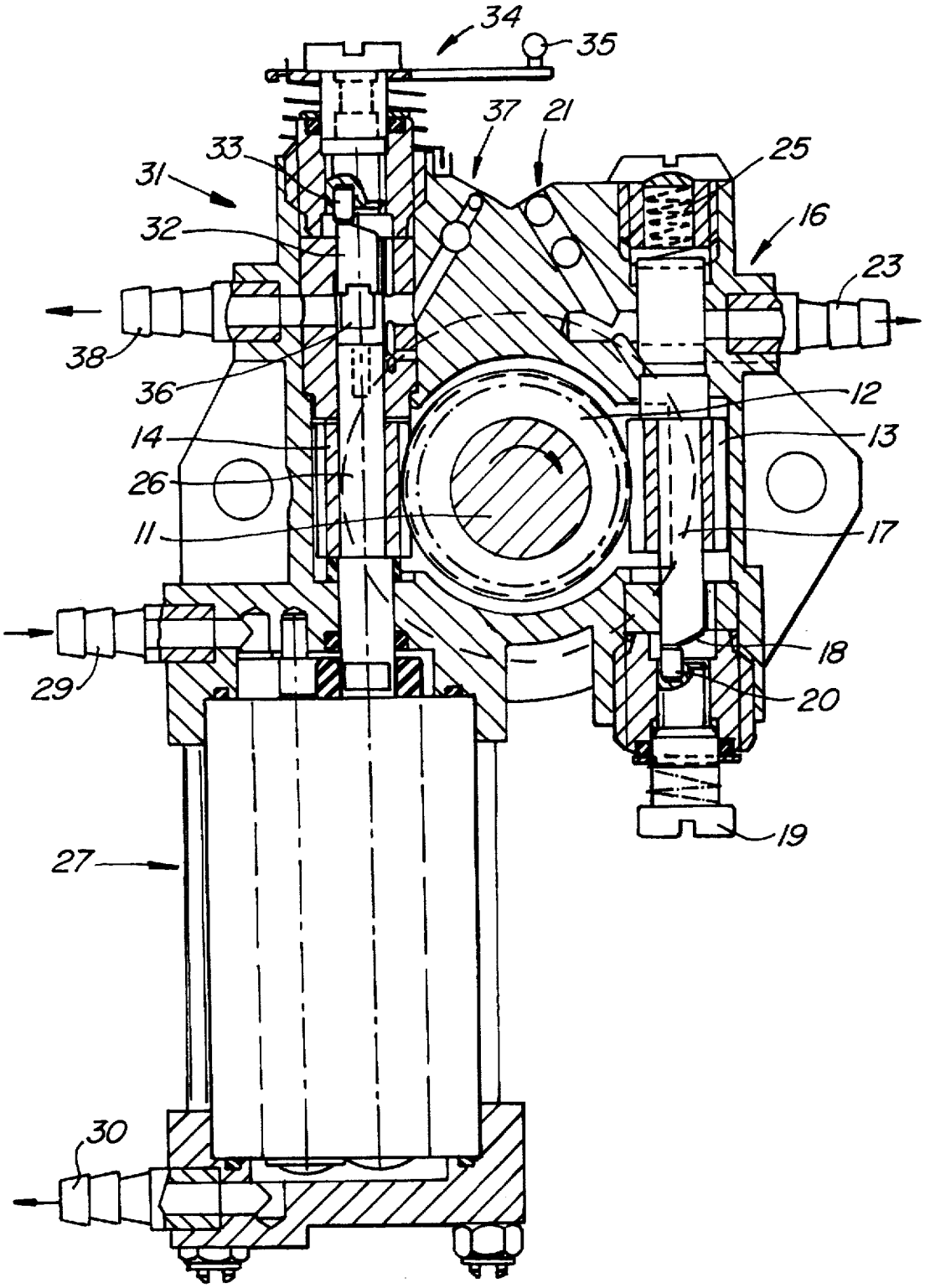
FIG. 2 shows a second embodiment of the invention in section transversely to the crankshaft axis.
Figure 3:
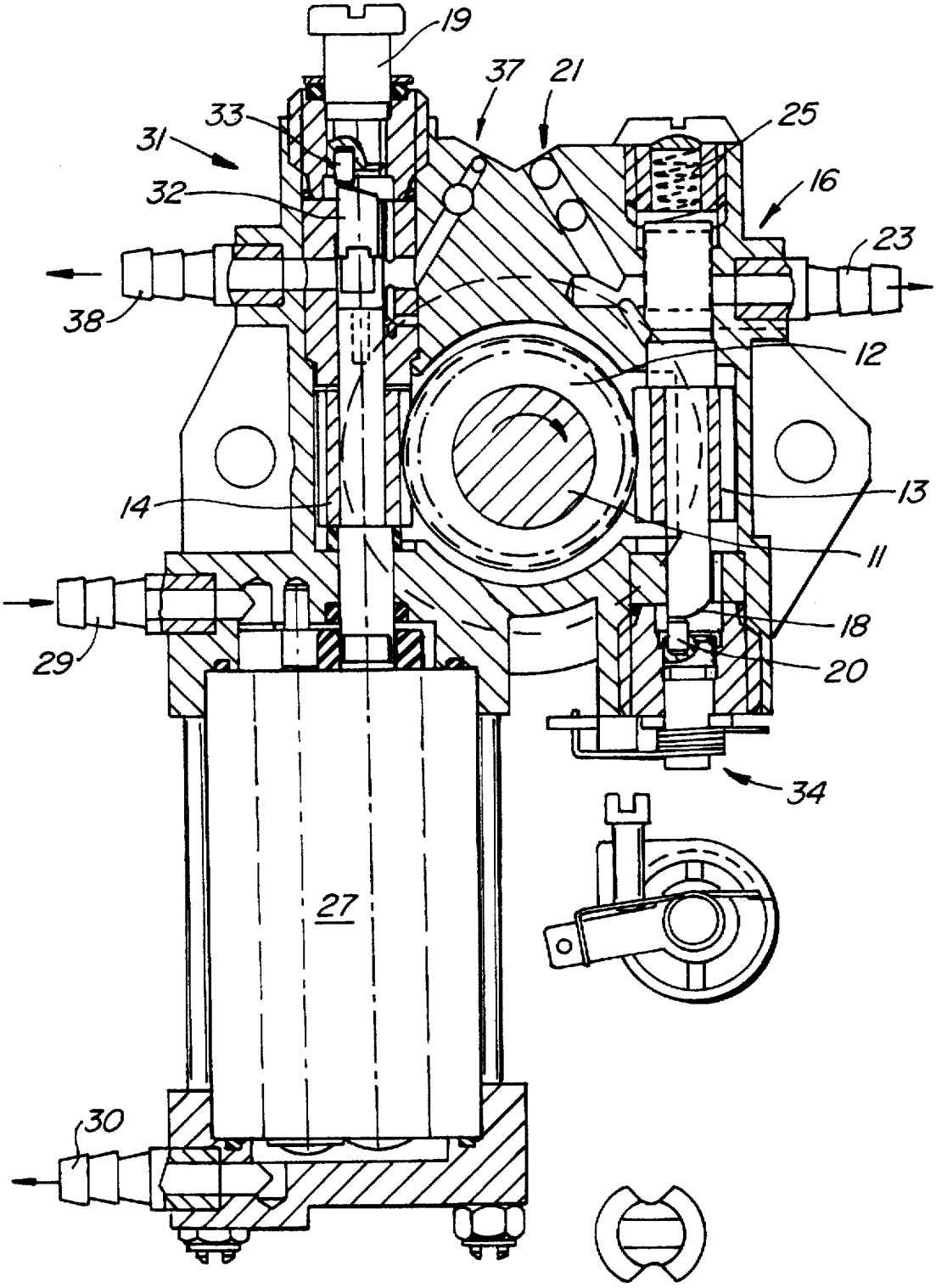
FIG. 3 shows a third embodiment of the invention in section transversely to the crankshaft axis.

The devices FIGS. 1 through 3 all possess a housing 10, a helical gear wheel 12 mounted on the crankshaft 11 which is in engagement on opposite sides with mating gear wheels 13 and 14. The mating gear wheel 13 drives the lubricant pump 16 mounted in the housing portion 15 by means of the drive shaft 17 of the latter, while the drive shaft 17 of the piston of the lubricant pump 16 coincidently forms time the trunnion for the mating gear wheel 13. This piston possesses an oblique anterior surface 18 as cam plate, which bears against a lifting stud 20 retained in the housing 15 by means of a set-screw 19. When the mating gear wheel 13 rotates, the drive shaft 17 executes oscillating upward and downward movements, whereby (see Fig.1) the oil supplied to the inlet connection pieces 21,22 is moved under pressure into the outlets 23,24. The drive shaft is supported in this oscillating movement by the spring 25. Thus, in the embodiment shown in FIG. 1, the two feed units 161 and 162 formed by the drive shaft 17, constitute the lubricant pump 16, whose pumping action is disparate on account of the differently effective piston surface areas. In a corresponding manner, the drive shaft 26 on the opposite side constitutes a lifting stud for the mating gear wheel 14 and serves to drive a fuel pump 27, whose feed unit 28 draws in fuel via the inlet connection piece 29 and pumps the fuel into the outlet connection piece 30. The two drive shafts for the Lubricant pump 16 and the fuel pump 27 are aligned in parallel to each other. A compact, tight form of construction results hereby, which is advantageous in internal combustion engines for manually guided implements. Alternatively, it is possible to dispose the drive shafts 17 and 26 to be arranged in a V-shaped manner relative to each other.

In the embodiment illustrated in Fig.2, the helical gear wheel 12 is driven by the crank shaft 11, which engages the mating gear wheels 13,14. As in the first embodiment the drive shaft 17 serves as trunnion for the mating gear wheel 13. The drive shaft 17 forms part of a lubricant pump 16 delivering the Lubricant via the inlet 21 into the outlet connection piece 23. Corresponding identical parts, such as the cam plate 18, the lifting stud 20 and the adjusting screw 19, as well as the spring 25, are designated with the same reference numbers as in Fig.1. On the opposite side, the mating gear wheel 14 and the drive shaft 26 serve both for driving the fuel pump 27 as well as for driving the lubricant pump 31, which is mounted above the fuel pump 27. The drive shaft 26 possesses, at its top end, an oblique anterior surface serving as cam plate 32, which bears against an adjustable lifting stud 33. An adjusting unit 34, which can be operated by means of a manual actuating lever 35 is used for the adjustment of the lifting stud 33 in the Longitudinal axial direction of the drive shaft. The piston 36, which forms part of the drive shaft 26, delivers lubricant into the outlet 38 via an inlet 37 in a manner known in the art for plunger pumps. The adjusting unit 34 is mounted above the drive shafts 17 and 26 and transversally to the longitudinal axis of the crankshaft 11.

In the embodiment shown in FIG. 3, which is constructed in correspondence with the device of FIG. 2, the controllable adjusting unit 34 for regulating the pump delivery of the Lubricant pump 16 is mounted underneath the mating gear wheels 13 and 14, while the set-screw 19 serves for the axial displacement of the Lifting stud 33, as described above, for regulating the delivery of the Lubricant pump 31. This device is designed as a secondary unit block of an internal combustion engine, in particular for two-stroke engine chain saws, is of compact construction and, while using few components, utilizes the energy available from the crankshaft rotation when the engine is in operation.

LIST OF REFERENCE NUMBERS housing 10
crankshaft 11
helical gear wheel 12
mating gear wheels 13,14
housing portion 15
Lubricant pump 16
drive shaft 17
oblique surface area 18
set-screw 19
lifting stud 20
inlet connection piece 21,22
outlets 23,24
spring 25
drive shaft 26
fuel pump 27
feed unit 28
inlet connection piece 29
outlet connection piece 30
lubricant pump 31
cam plate 32
lifting stud 33
adjusting unit 34
actuating lever 35
piston 36
inlet 37
outlet 38
feed units 161,162.

What is claimed is:

1. A combined fuel injection and lubricant feed for an internal combustion engine of a type utilized in chain saws comprising in combination:

a crank shaft rotatable with operation of the internal combustion engine;

a helical gear wheel mounted on and rotatable with the crank shaft;

a first mating gear wheel in driving engagement with the helical gear wheel;

a lubricant pump driven by the first mating gear wheel;

a fuel pump;

a second mating gear wheel for driving the fuel pump; and, the second mating gear wheel driven from the helical gear wheel whereby both the lubricant pump and the fuel pump are commonly driven from the helical gear wheel.

2. A combined fuel injection and lubricant feed for an internal combustion engine according to claim 1 and further including:

means for adjustably varying output of the lubricant pump.

3. A combined fuel injection and lubricant feed for an internal combustion engine according to claim 2 and further including:

the means for adjustably varying output of the lubricant pump includes an oblique surface bearing against a lifting stud.

4. A combined fuel injection and lubricant feed for an internal combustion engine according to claim 1 and further including:

a lubricant pump drive shaft between the first mating gear wheel and the lubricant pump for driving the lubricant pump;

a fuel pump drive shaft between the second mating gear wheel and the fuel pump for driving the fuel pump; and, the lubricant pump drive shaft and the fuel pump drive shaft in parallel spaced apart relation one to another.

5. A combined fuel injection and lubricant feed for an internal combustion engine according to claim 1 and further including:

a second lubricant pump driven by the first mating gear wheel.

6. A combined fuel injection and lubricant feed for an internal combustion engine according to claim 5 and further including:

the first lubricant pump includes a first piston with a first area for delivering lubricants at a first rate; and, the second lubricant pump includes a second piston with a second area for delivering lubricants at a second rate.

7. A combined fuel injection and lubricant feed for an internal combustion engine according to claim 3 and further including:

means for adjusting the output of the second lubricant pump.

8. A combined fuel injection and lubricant feed for an internal combustion engine according to claim 1 and further including:

a housing block; and, the mating gear wheels are axially guided on both sides by the housing block.

* * * * *